US010858206B2

(12) United States Patent
Yoshii et al.

(10) Patent No.: US 10,858,206 B2
(45) Date of Patent: Dec. 8, 2020

(54) RECORDING-MATERIAL-STORING DEVICE AND IMAGE FORMING APPARATUS

(71) Applicant: FUJI XEROX CO., LTD., Tokyo (JP)

(72) Inventors: Hajime Yoshii, Kanagawa (JP); Yambe Chi, Incheon (KR); Haanu Jon, Incheon (KR); Jonson I, Incheon (KR); Jonfun Imu, Incheon (KR); Girufun Ri, Incheon (KR); Donhon Jon, Incheon (KR); Myonjin O, Incheon (KR); Jungaru I, Incheon (KR); Minji Kimu, Incheon (KR); Kyofun Byon, Incheon (KR)

(73) Assignee: FUJI XEROX CO., LTD., Tokyo (JP)

( * ) Notice: Subject to any disclaimer, the term of this patent is extended or adjusted under 35 U.S.C. 154(b) by 25 days.

(21) Appl. No.: 16/286,628

(22) Filed: Feb. 27, 2019

(65) Prior Publication Data

US 2020/0087087 A1 Mar. 19, 2020

(30) Foreign Application Priority Data

Sep. 18, 2018 (JP) ..... 2018-174108

(51) Int. Cl.

*B65H 1/04* (2006.01)
*B65H 1/26* (2006.01)
*B65H 1/08* (2006.01)

(52) U.S. Cl.

CPC ..... *B65H 1/04* (2013.01); *B65H 1/08* (2013.01); *B65H 1/266* (2013.01); *B65H 2405/11425* (2013.01); *B65H 2511/12* (2013.01)

(58) Field of Classification Search

CPC .... B65H 1/04; B65H 1/266; B65H 2405/114; B65H 2405/11425; B65H 2405/1144; B65H 2511/10; B65H 2511/12; B65H 2553/612

See application file for complete search history.

(56) References Cited

U.S. PATENT DOCUMENTS 5,647,585 A * 7/1997 Cheong ..... B65H 1/266 271/171
2006/0087073 A1* 4/2006 Yamagishi ..... G03G 15/6502 271/171
2008/0179818 A1* 7/2008 Hashimoto ..... B65H 1/266 271/145
2017/0001816 A1* 1/2017 Ichikawa ..... B65H 1/266
2018/0139340 A1* 5/2018 Miyamoto ..... B65H 1/26

FOREIGN PATENT DOCUMENTS

JP 2013-79120 5/2013

* cited by examiner

*Primary Examiner* — Prasad V Gokhale
(74) *Attorney, Agent, or Firm* — JCIPRNET

(57) ABSTRACT

A recording-material-storing device includes a detection object whose position is to be detected, a pressing portion that is movable toward and away from a side of a recording material placed in the recording-material-storing device and is to be pressed against the side, and a moving portion that moves the detection object by undergoing a relative motion with respect to the pressing portion when the pressing portion is moved.

12 Claims, 8 Drawing Sheets

RECORDING-MATERIAL-STORING DEVICE AND IMAGE FORMING APPARATUS

CROSS-REFERENCE TO RELATED APPLICATIONS

This application is based on and claims priority under 35 USC 119 from Japanese Patent Application No. 2018-174108 filed Sep. 18, 2018.

BACKGROUND

(i) Technical Field

The present disclosure relates to a recording-material-storing device and an image forming apparatus.

(ii) Related Art

A sheet feeding device disclosed by Japanese Unexamined Patent Application Publication No. 2013-79120 includes a size-detection lever provided in such a manner as to be displaceable in correspondence with the size of sheets.

In some recording-material-storing devices, a detection object is moved in correspondence with the movement of a pressing portion that is pressed against a side of a recording material, and the position of the detection object is detected, whereby the size of the recording material is detected.

The detection object is moved in the following mechanism, for example. A movable portion that moves together with the detection object has an inclined part that is inclined with respect to the direction in which the pressing portion moves, and an element that moves together with the pressing portion is pressed against the inclined part, whereby the detection object is moved. In such a mechanism where the element that moves together with the pressing portion is pressed against the inclined part, if the angle of inclination of the inclined part is too large, a problem such as a reduction in the smoothness in the movement of the pressing portion tends to occur.

SUMMARY

Aspects of non-limiting embodiments of the present disclosure relate to causing a detection object to move even if a movable portion that moves together with the detection object has no inclined part, or to reducing the angle of inclination of an inclined part provided to the movable portion that moves together with the detection object to a value smaller than in a case where the detection object is moved only by the use of a mechanism in which an element that moves together with the pressing portion is pressed against the inclined part.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided a recording-material-storing device including a detection object whose position is to be detected, a pressing portion that is movable toward and away from a side of a recording material placed in the recording-material-storing device and is to be pressed against the side, and a moving portion that moves the detection object by undergoing a relative motion with respect to the pressing portion when the pressing portion is moved.

BRIEF DESCRIPTION OF THE DRAWINGS

An exemplary embodiment of the present disclosure will be described in detail based on the following figures, wherein.

DETAILED DESCRIPTION

Figure 1:
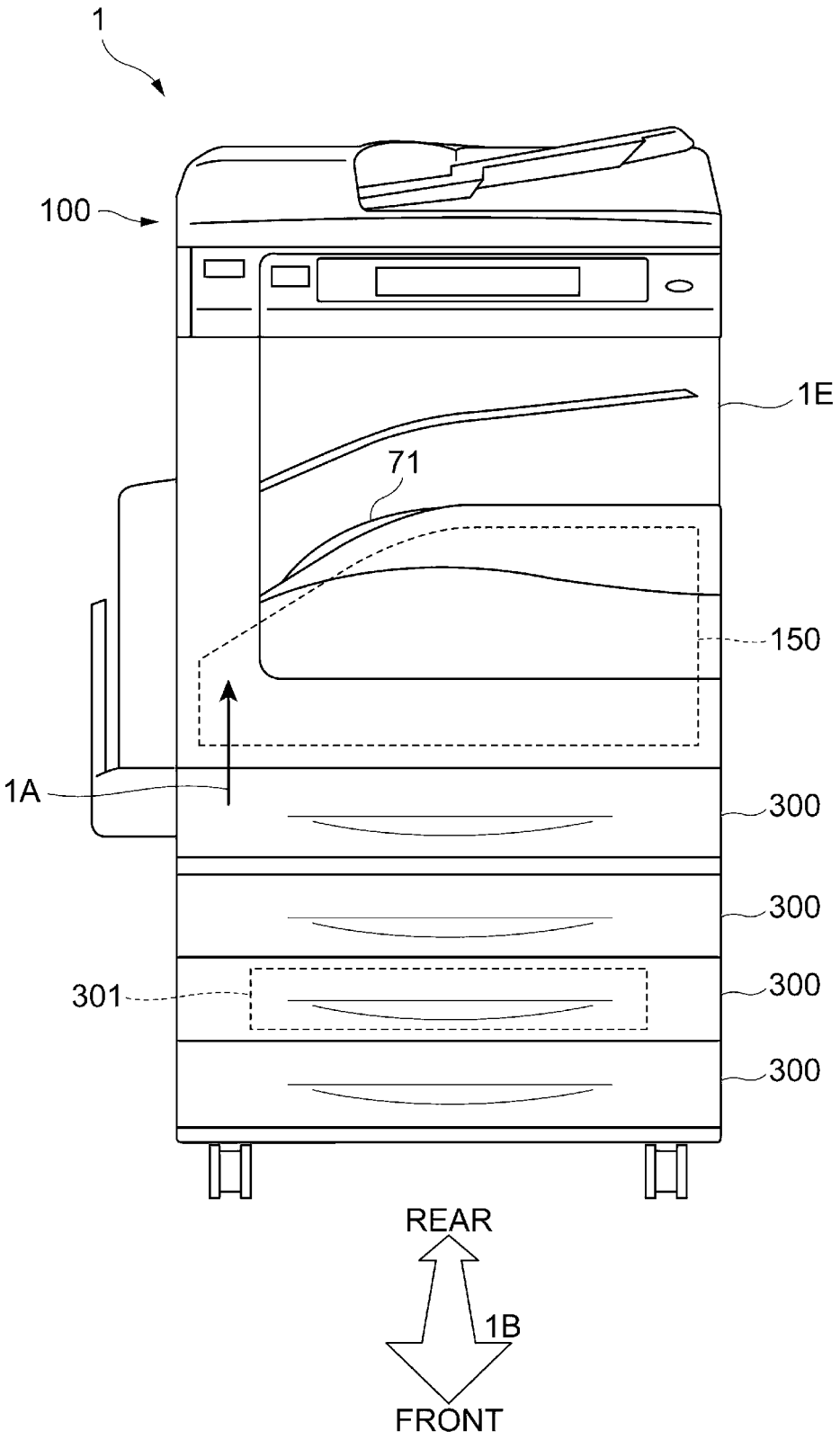
FIG. 1 illustrates an image forming apparatus.

FIG. 1 illustrates an image forming apparatus 1 according to an exemplary embodiment.

The image forming apparatus 1 includes an image reading device 100 that reads an image on an original.

The image forming apparatus 1 further includes an image forming unit 150 that forms an image on a sheet as an exemplary recording material.

The image forming apparatus 1 further includes a plurality of sheet storing devices 300 as exemplary recording-material-storing devices. The sheet storing devices 300 each store sheets to be supplied to the image forming unit 150.

The image flowing unit 150 is an exemplary image forming device and forms an image on a sheet by a so-called electrophotographic method. The method of image formation is not limited to the electrophotographic method and may be an inkjet method or the like.

In the process of image formation by the image forming unit 150, a sheet is picked up from one of the plurality of sheet storing devices 300 and is supplied to the image forming unit 150 as represented by arrow 1A.

Then, an image is formed on the sheet by the image forming unit 150, and the sheet having the image formed thereon is placed on a sheet stacking portion 71.

The sheet storing devices 300 each have a grip 301. In cases such as to supply sheets into any of the sheet storing devices 300, an operator takes the grip 301 and draws out the sheet storing device 300 in a first direction represented by arrow 1B.

In other words, the sheet storing devices 300 are each movable in the depth direction of the image forming apparatus 1. In cases such as to supply sheets into any of the sheet storing devices 300, the sheet storing device 300 is drawn out toward the near side in FIG. 1 (toward the front side of the image forming apparatus 1).

When the supplying of sheets into the sheet storing device 300 or any other like operation has been finished, the sheet storing device 300 is pushed in a second direction opposite to the first direction (pushed toward the rear side of the image forming apparatus 1) and is returned to the initial position.

Figure 2:
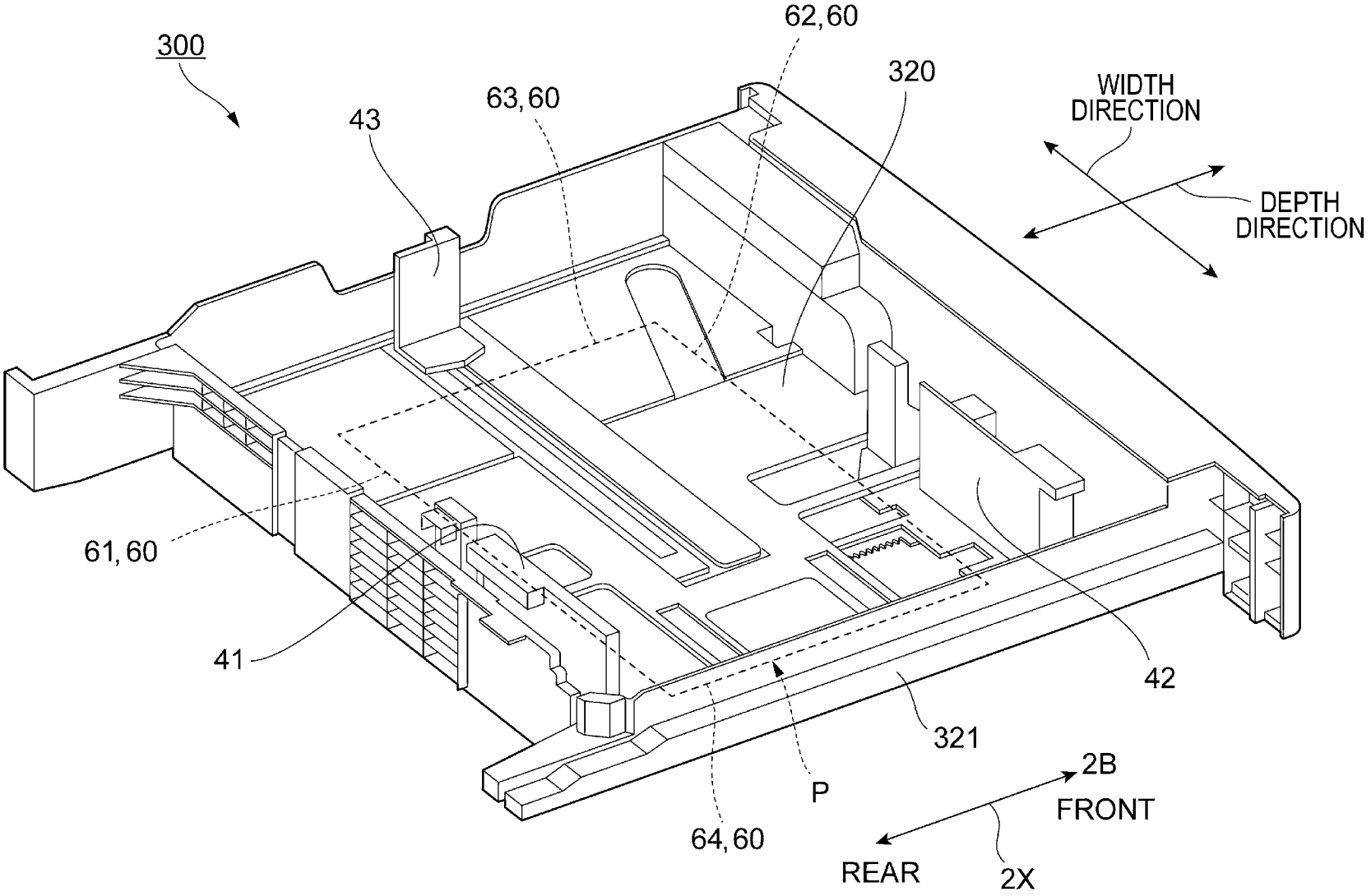
FIG. 2 is a rear perspective view of a sheet storing device.

FIG. 2 is a rear perspective view of the sheet storing device 300.

The sheet storing device 300 includes a box-shaped device body 321 in which sheets P are to be stored.

As illustrated in FIG. 2, the device body 321 includes thereinside a plate-like supporting portion 320 that supports the sheets P to be stacked thereon.

The sheet storing device 300 according to the present exemplary embodiment further includes a first pressing portion 41 and a second pressing portion 42 that are to be pressed against respective sides of the stack of sheets P.

The first pressing portion 41 and the second pressing portion 42 are provided at different positions in a direction represented by arrow 2X illustrated in FIG. 2.

In other words, the first pressing portion 41 and the second pressing portion 42 are provided at different positions in the direction in which the sheet storing device 300 is drawn out (in the direction represented by arrow 1B in FIG. 1, or toward a side pointed by arrowhead 2B in FIG. 2).

As illustrated in FIG. 2, the second pressing portion 42 is provided on the downstream side with respect to the first pressing portion 41 in the direction in which the sheet storing device 300 is drawn out.

In other words, in the present exemplary embodiment, the first pressing portion 41 is positioned on the rear side, and the second pressing portion 42 is positioned on the front side.

The first pressing portion 41 and the second pressing portion 42 are each movable toward and away from a corresponding one of sides 60 of the stack of sheets P to be placed on the supporting portion 320.

Each sheet P has a rectangular shape and has a first side 61 and a second side 62 that are opposite each other, and a third side 63 and a fourth side 64 that are opposite each other.

The first pressing portion 41 is movable toward and away from the first side 61 of the sheet P. The second pressing portion 42 is movable toward and away from the second side 62 that is opposite the first side 61.

That is, the first pressing portion 41 and the second pressing portion 42 are movable in the depth direction of the sheet storing device 300.

The sheet storing device 300 according to the present exemplary embodiment further includes a third pressing portion 43 that is to be pressed against the third side 63 of the sheet P. The third pressing portion 43 is movable in the width direction of the sheet storing device 300 (a direction intersecting (orthogonal to) the depth direction of the sheet storing device 300).

The supporting portion 320 has cuts, through holes, and the like. The first pressing portion 41 and the second pressing portion 42 are positioned in such cuts and through holes.

Hence, in the present exemplary embodiment, the first pressing portion 41 and the second pressing portion 42 do not interfere with the supporting portion 320.

In the present exemplary embodiment, the first pressing portion 41 and the second pressing portion 42 are operated by an operator in such a manner as to be pressed against the first side 61 and the second side 62, respectively.

The third pressing portion 43 is also operated by the operator in such a manner as to be pressed against the third side 63.

Thus, in the present exemplary embodiment, the sheet P is positioned.

Figure 3:
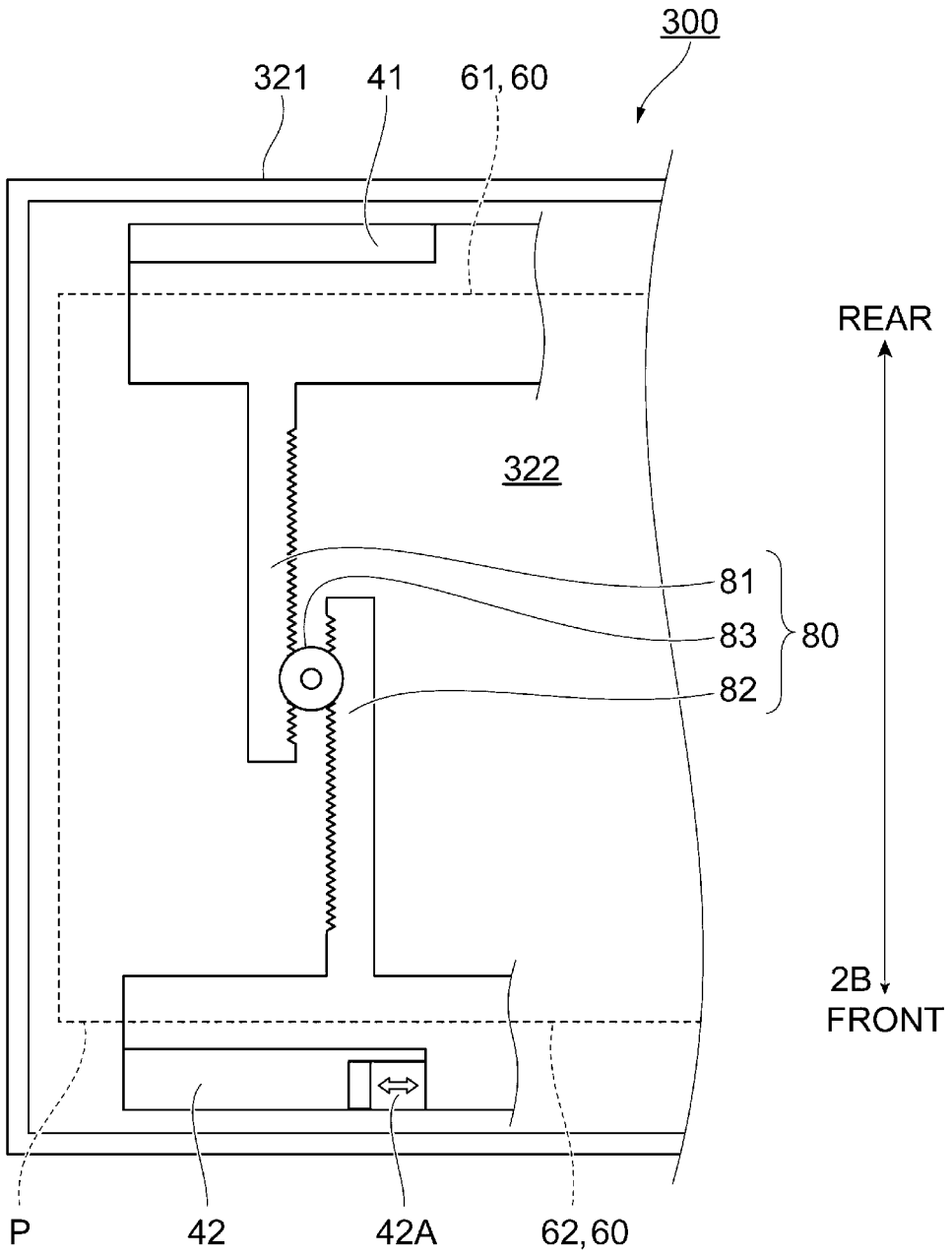
FIG. 3 is a top view of the sheet storing device and illustrates a part thereof where a first pressing portion and a second pressing portion are provided.

FIG. 3 is a top view of the sheet storing device 300 and illustrates a part thereof where the first pressing portion 41 and the second pressing portion 42 are provided.

The sheet storing device 300 according to the present exemplary embodiment includes an interlocking mechanism 80 that interlocks the first pressing portion 41 and the second pressing portion 42 with each other. In the present exemplary embodiment, when the second pressing portion 42 is moved by the operator, the first pressing portion 41 moves correspondingly.

Specifically, in the present exemplary embodiment, the second pressing portion 42 is positioned on the front side of the sheet storing device 300 and is to be touched and operated by the operator (the second pressing portion 42 is the object of operation by the operator).

In the present exemplary embodiment, when the second pressing portion 42 is moved by the operator toward the sheet P, the first pressing portion 41 interlocked with the second pressing portion 42 moves toward the sheet P.

When the second pressing portion 42 is moved by the operator away from the sheet P, the first pressing portion 41 interlocked with the second pressing portion 42 also moves away from the sheet P.

The interlocking mechanism 80 includes a first rack 81 connected to the first pressing portion 41 and extending toward the second pressing portion 42, and a second rack 82 connected to the second pressing portion 42 and extending toward the first pressing portion 41.

The interlocking mechanism 80 further includes a gear 83 that is in mesh with both the first rack 81 and the second rack 82.

In the present exemplary embodiment, when the operator moves the second pressing portion 42, the second rack 82 is moved, the gear 83 is rotated, and the first rack 81 is moved. Consequently, the first pressing portion 41 is moved.

The second pressing portion 42 includes an operated portion 42A to be operated by the operator. To move the second pressing portion 42, the operator operates the operated portion 42A.

More specifically, the second pressing portion 42 is fixed to a bottom 322 of the device body 321. To move the second pressing portion 42, the operator operates the operated portion 42A, whereby the second pressing portion 42 is unfixed. Consequently, the second pressing portion 42 is allowed to move.

Figure 4:
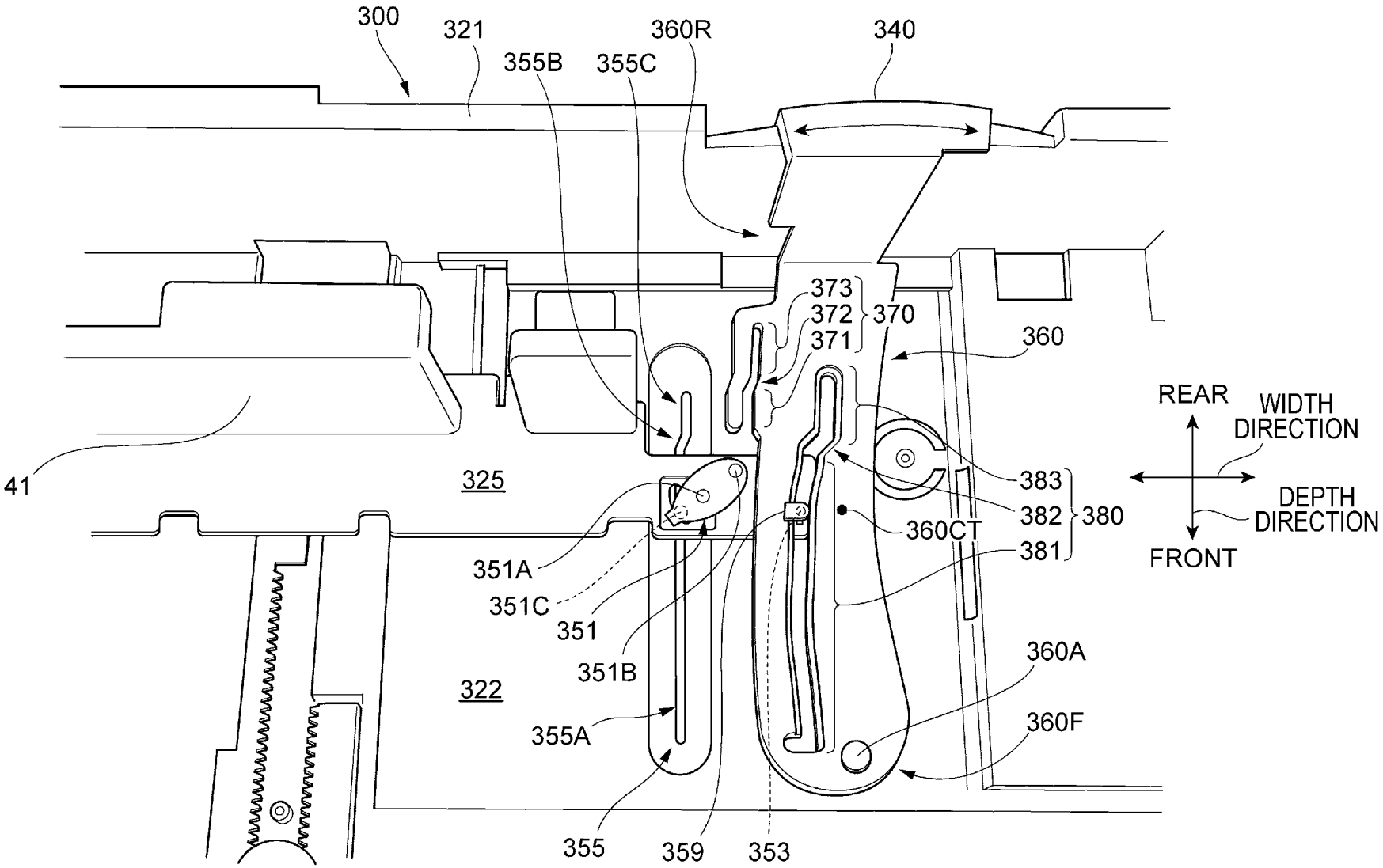
FIG. 4 is another top view of the sheet storing device and illustrates a rear part thereof.

FIG. 4 is a top view of the sheet storing device 300 and illustrates a rear part thereof. In FIG. 4, the supporting portion 320 (see FIG. 2) is not illustrated.

As illustrated in FIG. 4, the sheet storing device 300 according to the present exemplary embodiment includes an opposed portion 325 integrated with the first pressing portion 41 and that is opposed to the bottom 322 of the device body 321.

The opposed portion 325 extends in the width direction of the sheet storing device 300. The opposed portion 325 is connected to the first pressing portion 41 and moves together with the first pressing portion 41.

The opposed portion 325 is provided at the right end thereof in FIG. 4 with a moving member 351 for moving a detection object 340 (to be described in detail below).

The moving member 351 is rotatable on a rotation pin 351A. The moving member 351 is attached to the opposed portion 325 and moves together with the opposed portion 325.

The opposed portion 325 is further provided with a round-columnar projection 353 at the right end thereof and on the right side in FIG. 4 with respect to the moving member 351. The projection 353 projects upward. The projection 353 is also attached to the opposed portion 325 and moves together with the opposed portion 325.

The projection 353 is provided at the tip in the direction of projection thereof with an opposed portion 359 having a larger diameter than the projection 353 and part of which is opposed to a rotating member 360.

The moving member 351 includes a moving portion 351B and a contact portion 351C.

In the present exemplary embodiment, the moving portion 351B and the contact portion 351C are positioned in two respective areas that are across the rotation pin 351A from each other.

In the present exemplary embodiment, the distance between the moving portion 351B and the rotation pin 351A is longer than the distance between the contact portion 351C and the rotation pin 351A.

The moving portion 351B is a round-columnar upward protrusion. When the first pressing portion 41 and the second pressing portion 42 are moved, the moving portion 351B undergoes a relative motion with respect to the first pressing portion 41, thereby moving the detection object 340 (details will be described separately below).

Herein, the "relative motion" refers to a motion of the moving portion 351B relative to the first pressing portion 41.

In the present exemplary embodiment, as to be described separately below, the moving portion 351B moves together with the first pressing portion 41. While undergoing such a motion, the moving portion 351B also undergoes a relative motion with respect to the first pressing portion 41 (details will be described separately below).

The contact portion 351C is a round-columnar downward protrusion. The contact portion 351C is in contact with the bottom 322 of the device body 321 and receives a force from the bottom 322 (details will be described separately below).

In the present exemplary embodiment, the bottom 322 of the device body 321 has a bottom groove 355 extending in the depth direction of the sheet storing device 300. In the present exemplary embodiment, the contact portion 351C of the moving member 351 is positioned in the bottom groove 355.

The bottom groove 355 includes a first bottom groove 355A extending linearly in the depth direction of the sheet storing device 300, a second bottom groove 355B extending at an angle with respect to both the depth direction and the width direction of the sheet storing device 300, and a third bottom groove 355C extending linearly in the depth direction of the sheet storing device 300.

In the present exemplary embodiment, the first bottom groove 355A, the second bottom groove 355B, and the third bottom groove 355C are provided in that order from the front side toward the rear side of the sheet storing device 300.

The first bottom groove 355A and the third bottom groove 355C are provided at different positions in both the depth direction and the width direction of the sheet storing device 300.

The second bottom groove 355B connects the first bottom groove 355A and the third bottom groove 355C to each other.

In the present exemplary embodiment, the rotating member 360 as an exemplary rotating portion that rotates on a predetermined rotation center 360A is provided on the right side in FIG. 4 with respect to the moving member 351.

The rotating member 360 extends in the depth direction of the sheet storing device 300 and is provided at a position adjacent to the moving member 351 in the width direction of the sheet storing device 300.

In the present exemplary embodiment, the rotating member 360 has the rotation center 360A at a front end 360F thereof. The rotating member 360 rotates on the front end 360F.

In the present exemplary embodiment, the rotating member 360 includes the detection object 340 at a rear end 360R thereof.

The rotating member 360 has a first groove 370 and a second groove 380 both extending in the depth direction of the sheet storing device 300. The first groove 370 is provided nearer to the moving member 351 than the second groove 380.

In the rotating member 360, the first groove 370 is positioned nearer to the rear end 360R than a midpoint 360CT between the rear end 360R and the rotation center 360A.

The first groove 370 includes a first portion 371 extending in the depth direction of the sheet storing device 300, a second portion 372 connected to the first portion 371 and extending obliquely toward the rear side, and a third portion 373 connected to the second portion 372 and extending in the depth direction.

In the present exemplary embodiment, an end of the first groove 370 that is on the front side of the sheet storing device 300 is open. In the present exemplary embodiment, the moving portion 351B of the moving member 351 is to advance into the first groove 370.

In the present exemplary embodiment, as the moving portion 351B advances into the first groove 370, the moving portion 351B comes into contact with the rotating member 360 at a position nearer to the rear end 360R of the rotating member 360 than the midpoint 360CT.

The second groove 380 also includes a first portion 381 extending in the depth direction of the sheet storing device 300, a second portion 382 connected to the first portion 381 and extending obliquely toward the rear side, and a third portion 383 connected to the second portion 382 and extending in the depth direction.

In the present exemplary embodiment, the projection 353 provided on the opposed portion 325 is positioned in the second groove 380.

In the present exemplary embodiment, the first portion 381 of the second groove 380 gradually curves toward the right side in FIG. 4 while extending toward the rear side of the sheet storing device 300.

The rotating member 360 includes the detection object 340 at the rear end 360R thereof. The position of the detection object 340 is to be detected.

The rotating member 360 according to the present exemplary embodiment has the rear end 360R on a side thereof that is farther from the rotation center 360A. In other words, the rear end 360R of the rotating member 360 is a free end.

The detection object 340 is provided at the rear end 360R of the rotating member 360.

In the present exemplary embodiment, a detecting portion (not illustrated) that detects the position of the detection object 340 (see FIG. 4) is provided on a body 1E (see FIG. 1) of the image forming apparatus 1.

In the present exemplary embodiment, the detection object 340 moves in correspondence with the size of the sheet P stored in the sheet storing device 300 (details will be described separately below). The image forming apparatus 1 according to the present exemplary embodiment knows the size of the sheet P by detecting the position of the detection object 340.

Behaviors of the rotating member 360 and relevant elements will now be described.

Figure 5:
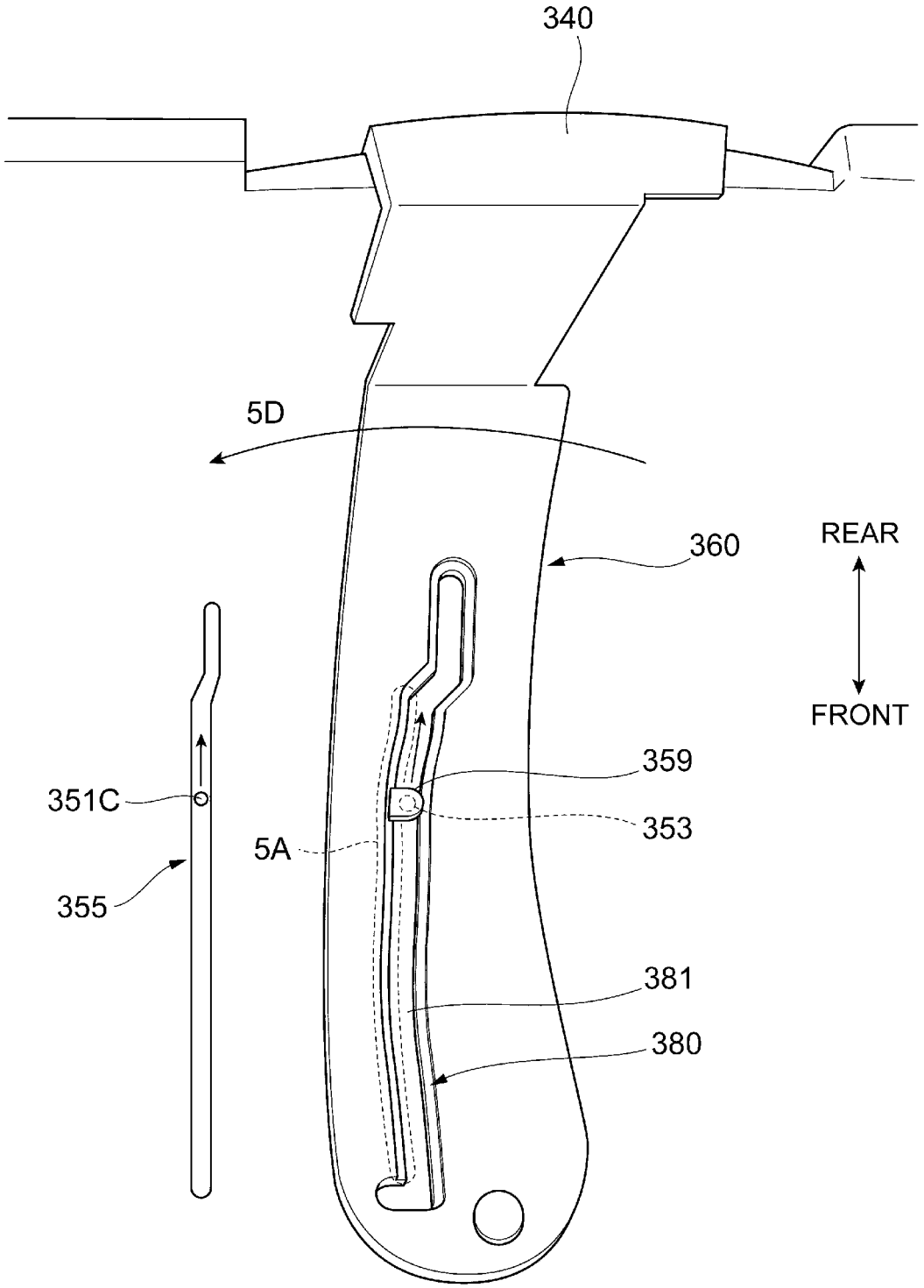
FIG. 5 illustrates how relevant elements move when a sheet of a large size is set in the sheet storing device.

FIG. 5 illustrates how relevant elements move when a sheet P of a large size is set in the sheet storing device 300. In FIG. 5, the opposed portion 325, the moving member 351, the first groove 370, and so forth are not illustrated.

To set a sheet P of a large size in the sheet storing device 300, an operator moves the second pressing portion 42 (see FIG. 2) toward the front side, whereby the first pressing portion 41 moves toward the rear side.

When the first pressing portion 41 moves toward the rear side, referring to FIG. 5, the contact portion 351C positioned in the bottom groove 355 moves toward the rear side and the projection 353 positioned in the second groove 380 also moves toward the rear side.

As the projection 353 moves toward the rear side, the projection 353 pushes the rotating member 360.

Specifically, the projection 353 pushes a part (a part denoted by 5A) of the rotating member 360 that forms a left wall of the first portion 381 of the second groove 380.

Hence, the rotating member 360 rotates in a direction represented by arrow 5D in FIG. 5, and the detection object 340 moves correspondingly.

Figure 6:
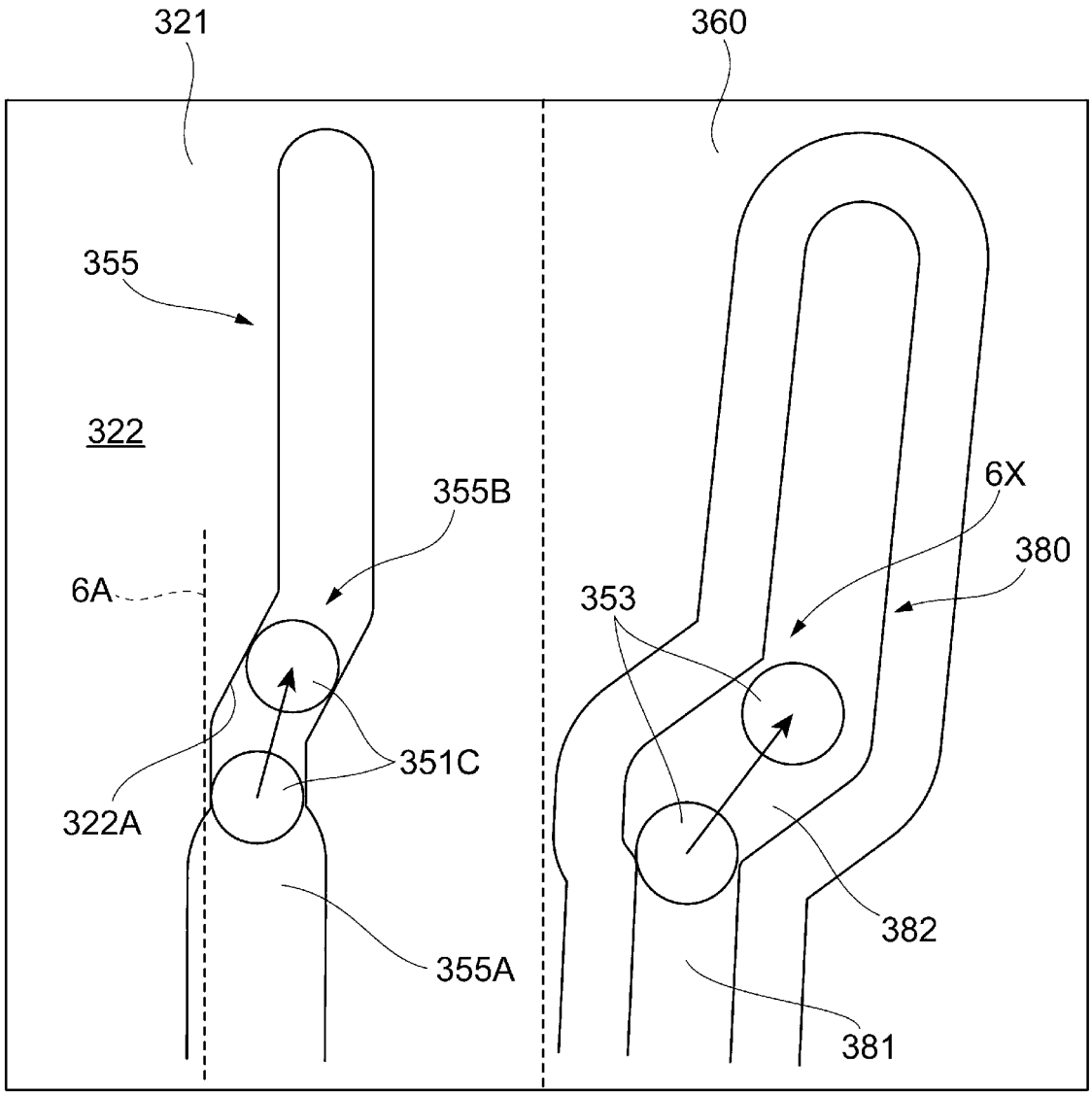
FIG. 6 illustrates a state where a contact portion and a projection have reached a second bottom groove of a bottom groove and a second portion of a second groove, respectively.

FIG. 6 illustrates a state where the contact portion 351C and the projection 353 have reached the second bottom groove 355B of the bottom groove 355 and the second portion 382 of the second groove 380, respectively.

In the present exemplary embodiment, when the first pressing portion 41 moves toward the rear side and reaches a predetermined position, referring to FIG. 6, the contact portion 351C reaches the second bottom groove 355B and the projection 353 reaches the second portion 382.

In the second groove 380, the second portion 382 is wider than the first portion 381. Therefore, in the present exemplary embodiment, when the projection 353 reaches the second portion 382, the projection 353 and the rotating member 360 go out of contact with each other.

Meanwhile, in the bottom groove 355, the second bottom groove 355B is narrower than the first bottom groove 355A. Therefore, in the present exemplary embodiment, when the contact portion 351C reaches the second bottom groove 355B, the contact portion 351C comes into contact with the bottom 322 of the device body 321.

More specifically, the contact portion 351C comes into contact with an inclined part 322A of the bottom 322. The inclined part 322A forms a left wall of the second bottom groove 355B.

Herein, the "inclined part" refers to a part that is inclined with respect to the direction in which the first pressing portion 41 moves (a direction represented by broken line 6A in FIG. 6). In other words, the "inclined part" refers to a part that is at an angle with respect to the depth direction of the sheet storing device 300.

In the present exemplary embodiment, the angle of inclination of the inclined part 322A is smaller than 45 degrees. Herein, the "angle of inclination" refers to an angle with respect to the direction in which the first pressing portion 41 moves (the direction represented by broken line GA in FIG. 6).

Figure 7A:
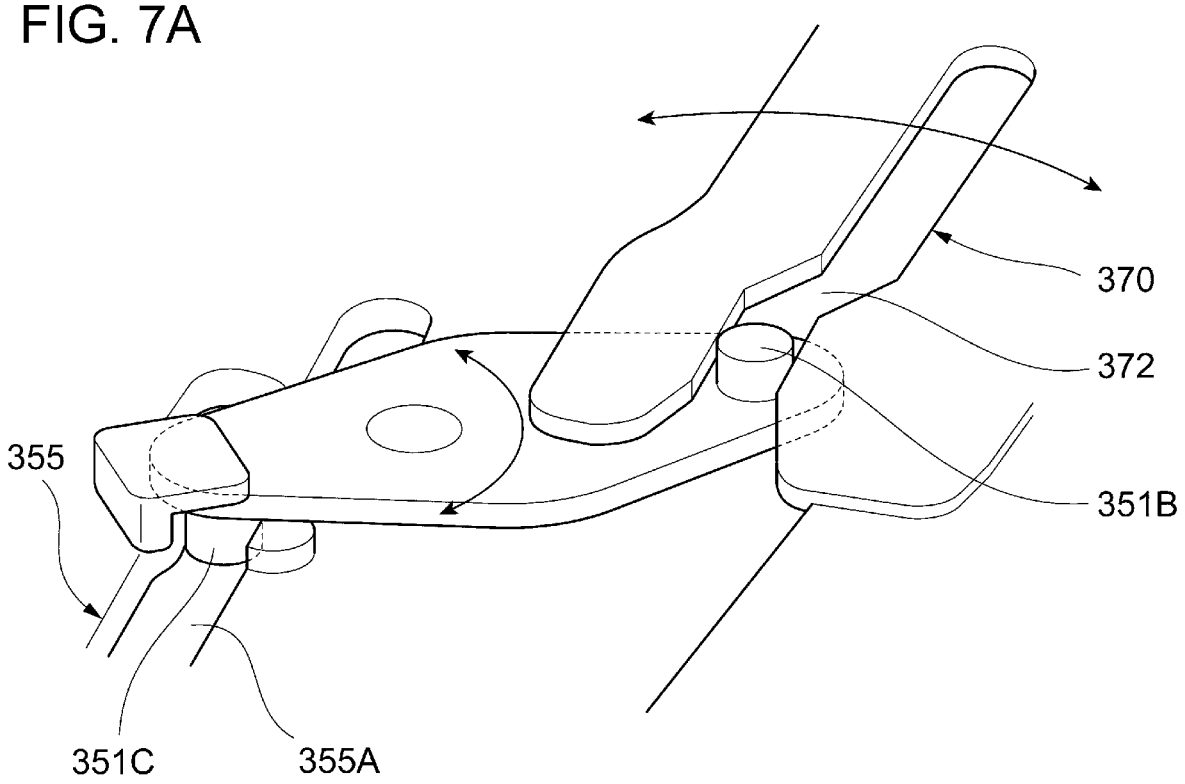
FIGS. 7A and 7B illustrate how relevant elements move.
Figure 7B:
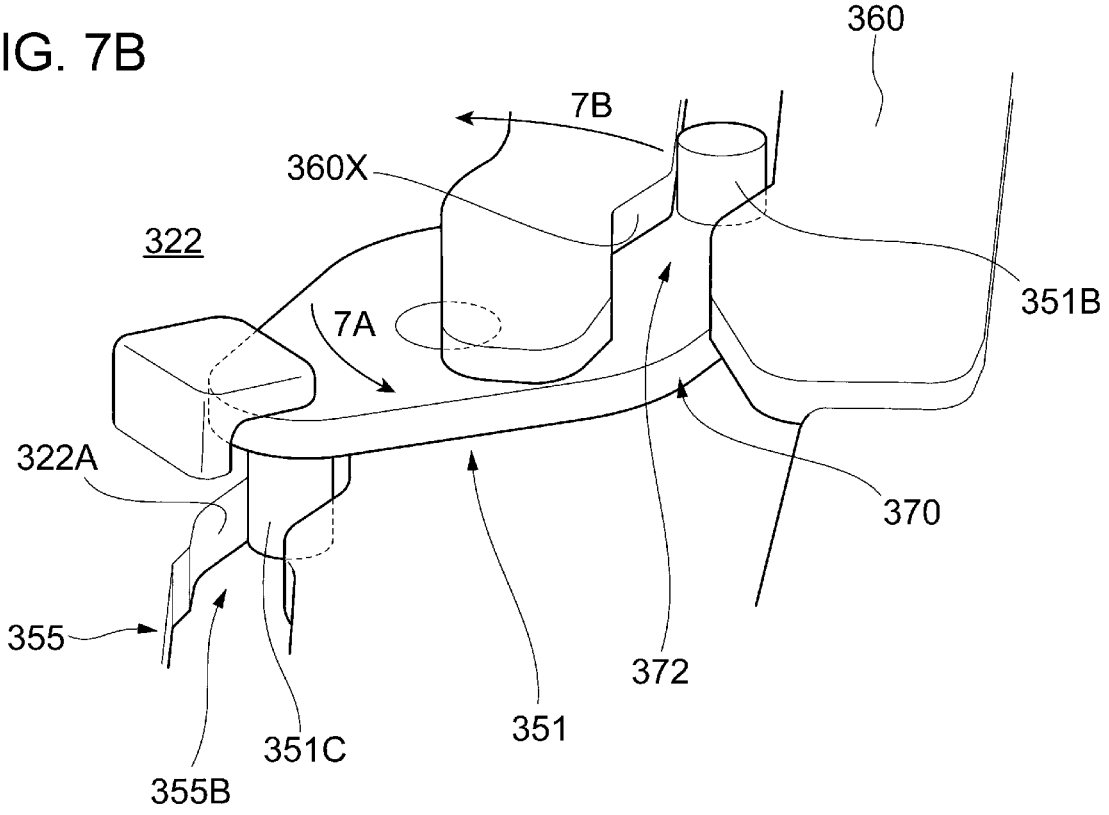

FIGS. 7A and 7B illustrate how relevant elements move. In the present exemplary embodiment, referring to FIG. 7A, immediately before the contact portion 351C reaches the second bottom groove 355B (see FIG. 6) of the bottom groove 355, the moving portion 351B advances into the first groove 370 and reaches a position immediately before the second portion 372 of the first groove 370.

Subsequently, in the present exemplary embodiment, the contact portion 351C moves while being in contact with the inclined part 322A of the bottom 322 as illustrated in FIG. 7B.

In other words, the contact portion 351C moves while being in contact with the inclined part 322A forming the left wall of the second bottom groove 355B of the bottom groove 355.

Hence, in the present exemplary embodiment, the moving member 351 rotates in a direction represented by arrow 7A illustrated in FIG. 7B. Accordingly, the moving portion 351E pushes the rotating member 360, whereby the rotating member 360 rotates in a direction represented by arrow 7B.

In the present exemplary embodiment, when the contact portion 351C (see FIG. 7B) comes into contact with the inclined part 322A, the moving portion 351B comes into contact with an inclined part 360X illustrated in FIG. 7B.

In other words, the moving portion 351B comes into contact with the rotating member 360 at the inclined part 360X that forms the left wall of the second portion 372 of the first groove 370. Hence, the rotating member 360 further rotates in the direction of arrow 7B illustrated in FIG. 7B.

As with the angle of inclination of the inclined part 322A, the angle of inclination (an angle with respect to the direction in which the first pressing portion 41 moves) of the inclined part 360X is also smaller than 45 degrees.

The rotating member 360 according to the present exemplary embodiment is regarded as an accompanying portion that moves together with the detection object 340. The moving portion 351B (see FIG. 7B) moves the accompanying portion, thereby moving the detection object 340.

In the present exemplary embodiment, a part of the accompanying portion with which the moving portion 351B comes into contact has the inclined part 360X as described above.

In the present exemplary embodiment, the moving portion 351B itself undergoes the above relative motion. Furthermore, the moving portion 351B comes into contact with the inclined part 360X. With these two motions, the rotation of the rotating member 360 is realized.

In other words, in the present exemplary embodiment, when the first pressing portion 41 and the second pressing portion 42 are moved, the moving portion 351B undergoes the relative motion with respect to the first pressing portion 41. While undergoing the relative motion, the moving portion 351B comes into contact with the inclined part 360X.

Figure 8:
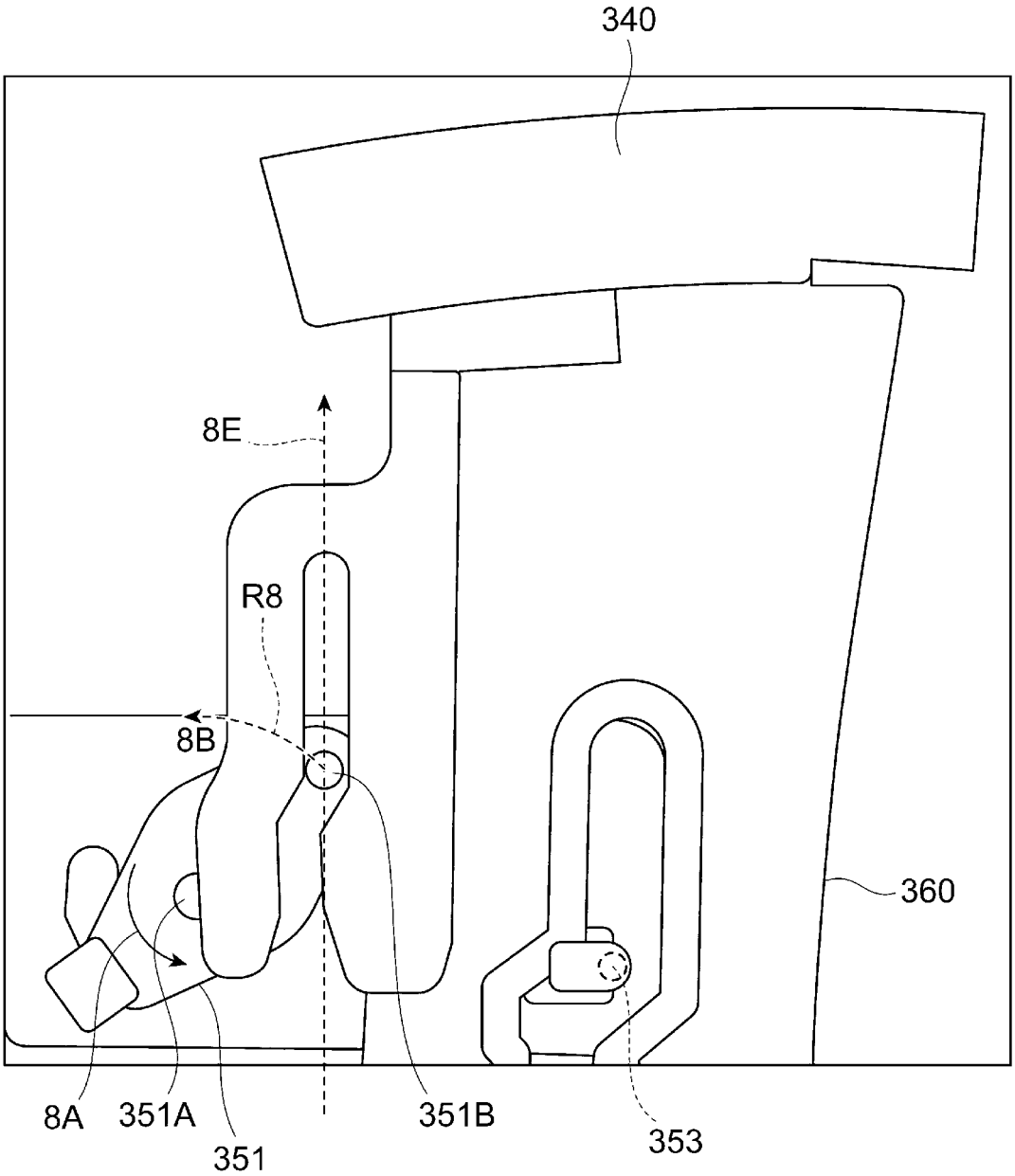
FIG. 8 is a top view of relevant elements in the state illustrated in FIG. 7B.

FIG. 8 is a top view of relevant elements in the state illustrated in FIG. 7B.

In the present exemplary embodiment, the moving member 351 rotates in a direction represented by arrow 8A, whereby the moving portion 351B moves as represented by arrow 8B.

In other words, the moving portion 351B moves along a locus R8 centered at the rotation pin 351A (the rotation center). More specifically, the moving portion 351B moves along the locus R8 centered at the rotation pin 351A (the rotation center) while moving together with the first pressing portion 41 toward the rear side of the sheet storing device 300.

In the present exemplary embodiment, as described above, the moving portion 351E undergoes the relative motion with respect to the first pressing portion 41. While undergoing the relative motion, the moving portion 351B moves in a direction intersecting the direction in which the first pressing portion 41 moves.

More specifically, the direction represented by arrow 8E in FIG. 8 corresponds to the direction in which the first pressing portion 41 moves. The moving portion 351B moves in a direction intersecting the direction represented by arrow 8E.

In the present exemplary embodiment, when the first pressing portion 41 is moved, the moving portion 351B undergoes the above relative motion. When the moving portion 351B undergoes the relative motion, the rotating member 360 rotates, whereby the detection object 340 moves.

In the present exemplary embodiment, the above relative motion of the moving portion 351B with respect to the first pressing portion 41 is realized by the use of an operation load applied to the first pressing portion 41 and the second pressing portion 42 by the operator.

The above relative motion of the moving portion 351B is not limited to be realized by the use of the operation load applied by the operator and may alternatively be realized by the use of a driving force generated by a drive source such as a motor.

In the present exemplary embodiment, as described above, after the moving portion 351B reaches the first groove 370, the moving portion 351B rotates the rotating member 360.

Before the moving portion 351B reaches the first groove 370, the projection 353 (see FIG. 5) as an exemplary second moving portion rotates the rotating member 360.

The present exemplary embodiment employs the projection 353 that moves the detection object 340 when the moving portion 351B is not in the above relative motion.

The projection 353 comes into contact with and thus rotates the rotating member 360 until the moving portion 351B (not illustrated in FIG. 5) reaches the first groove 370 (not illustrated in FIG. 5).

More specifically, the projection 353 is provided in such a manner as to move when the first pressing portion 41 moves, and pushes and thus rotates the rotating member 360 until the first pressing portion 41 reaches a predetermined position defined on the rear side.

In the present exemplary embodiment, as described above, the rotating member 360 is regarded as an accompanying portion that moves together with the detection object 340, and the projection 353 as an exemplary second moving portion moves the detection object 340 by moving the accompanying portion.

In the present exemplary embodiment, as the moving portion 351B undergoes the above relative motion and thus moves the detection object 340, the projection 353 and the accompanying portion (the rotating member 360) go out of contact with each other as indicated by reference numeral 6X in FIG. 6.

In other words, in the present exemplary embodiment, before the moving portion 351B starts to undergo the above relative motion, the projection 353 rotates the rotating member 360.

That is, in the present exemplary embodiment, when the moving portion 351B starts to undergo the above relative motion, the functional element that rotates the rotating member 360 changes from the projection 353 to the moving portion 351B.

Meanwhile, the detection object 340 movable even without the use of the moving portion 351B described above. For example, the detection object 340 is also movable by simply pressing the accompanying portion that moves together with the first pressing portion 41 and the second pressing portion 42 against an inclined part provided to the detection object 340.

In such a configuration where the accompanying portion is simply pressed against the inclined part, if the angle of inclination of the inclined part is too large, a reaction force acting on the accompanying portion becomes large. Consequently, the smoothness in the movements of the first pressing portion 41 and the second pressing portion 42 is reduced.

Specifically, for example, when the first pressing portion 41 and the second pressing portion 42 are moved from respective positions for the A3 size to respective positions for the 12-inch size (larger than the A3 size), the angle of inclination of the inclined part inevitably needs to be increased. In such a case, the smoothness in the movements of the first pressing portion 41 and the second pressing portion 42 is reduced.

Such a situation occurs as follows. Since the difference between the A3 size and the 12-inch size is small, the length of travel of each of the first pressing portion 41 and the second pressing portion 42 is small.

Even if the length of travel of each of the first pressing portion 41 and the second pressing portion 42 is small, the angle of inclination of the inclined part has to be increased in order to provide a sufficient length of travel of the detection object 340. In addition, to prevent the misdetection of the size of the sheet P, a sufficient length of travel of the detection object 340 needs to be provided. Accordingly, the angle of inclination of the inclined part has to be increased.

In such a case, as described above, the reaction force is increased, and the smoothness in the movements of the first pressing portion 41 and the second pressing portion 42 is therefore reduced.

In contrast, according to the present exemplary embodiment, the moving portion 351B undergoes the relative motion with respect to the first pressing portion 41 as described above.

Hence, in the present exemplary embodiment, the angle of inclination of the inclined part provided to the detection object 340 is reduced by the length of the relative motion.

Although not illustrated, in the configuration in which the moving portion 351B undergoes the relative motion as in the present exemplary embodiment, if a short length of travel of the detection object 340 is acceptable, the detection object 340 is movable even with no inclined part provided to the detection object 340.

The foregoing description of the exemplary embodiment of the present disclosure has been provided for the purposes of illustration and description. It is not intended to be exhaustive or to limit the disclosure to the precise forms disclosed. Obviously, many modifications and variations will be apparent to practitioners skilled in the art. The embodiment was chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A recording-material-storing device comprising:

a detection object whose position is to be detected;

a pressing portion that is movable toward and away from a side of a recording material placed in the recording-material-storing device and is to be pressed against the side;

a moving portion that moves the detection object by undergoing a relative motion with respect to the pressing portion when the pressing portion is moved; and a rotating portion that rotates on a predetermined rotation center, wherein the moving portion rotates the rotating portion by coming into contact with a part of the rotating portion.

2. The recording-material-storing device according to claim 1, wherein the moving portion that is in the relative motion with respect to the pressing portion moves in a direction intersecting a direction in which the pressing portion moves.

3. The recording-material-storing device according to claim 1, wherein the relative motion of the moving portion with respect to the pressing portion is realized by a use of an operation load applied to the pressing portion by an operator.

4. The recording-material-storing device according to claim 1, wherein the moving portion that is moving together with the pressing portion moves the detection object by moving along a locus centered at a predetermined position.

5. The recording-material-storing device according to claim 1, wherein the detection object is provided on the rotating portion, and wherein the moving portion moves the detection object by rotating the rotating portion.

6. The recording-material-storing device according to claim 1, wherein the rotating portion has a first end on a side farther from the predetermined rotation center, and wherein the detection object is provided at the first end of the rotating portion.

7. The recording-material-storing device according to claim 6, wherein the part of the rotating portion being nearer to the first end than a midpoint between the first end and the predetermined rotation center.

8. The recording-material-storing device according to claim 1, further comprising:

an accompanying portion that moves together with the detection object, wherein the moving portion moves the detection object by moving the accompanying portion, and wherein the accompanying portion includes an inclined part with which the moving portion comes into contact, the inclined part being inclined with respect to a direction in which the pressing portion moves.

9. The recording-material-storing device according to claim 8, wherein the moving portion comes into contact with the inclined part when the moving portion undergoes the relative motion with respect to the pressing portion.

10. The recording-material-storing device according to claim 1, further comprising:

a second moving portion that moves together with the pressing portion and moves the detection object when the moving portion is not in the relative motion.

11. The recording-material-storing device according to claim 10, further comprising:

an accompanying portion that moves together with the detection object, wherein the second moving portion moves the detection object by moving the accompanying portion, and wherein when the detection object is moved by the moving portion that is in the relative motion, the second moving portion and the accompanying portion go out of contact with each other.

12. An image forming apparatus comprising:

an image forming device that forms an image on a recording material; and a recording-material-storing device in which the recording material is to be stored, wherein the recording-material-storing device is the recording-material-storing device according to claim 1.

* * * * *